United States Patent [19]

Houseman

[11] Patent Number: 4,679,487

[45] Date of Patent: Jul. 14, 1987

[54] PROJECTILE FIRING WEAPON WITH A REPLACEABLE FIRING MECHANISM ACTUATOR CASSETTE

[75] Inventor: Walter R. Houseman, League City, Tex.

[73] Assignee: Custom Technical Enterprises, League City, Tex.

[21] Appl. No.: 619,926

[22] Filed: Jun. 12, 1984

[51] Int. Cl.[4] ..... F41D 11/02

[52] U.S. Cl. ..... 89/140; 89/142; 89/149; 42/75.03

[58] Field of Search ..... 89/128, 140, 141, 142, 89/149; 42/75 C, 69 A

[56] References Cited

U.S. PATENT DOCUMENTS

| | | | |
|---|---|---|---|
| 1,531,044 | 3/1925 | Sutter | 89/142 |
| 1,547,973 | 7/1925 | Sutter | 89/142 |

FOREIGN PATENT DOCUMENTS

| | | | |
|---|---|---|---|
| 320791 | 4/1957 | Switzerland | 89/142 |
| 552560 | 4/1943 | United Kingdom | 42/69 A |
| 643209 | 9/1950 | United Kingdom | 89/140 |

OTHER PUBLICATIONS

"Anschütz Match Trigger Units", Shooter's Bible, 1964 Edition, p. 69.

Melvin M. Johnson, Automatic Weapons of the World, 1945, p. 8.

TM 20-205, Dictionary of United States Army Terms, Jan. 18, 1944, p. 98.

*Primary Examiner*—Stephen C. Bentley

*Attorney, Agent, or Firm*—Bacon & Thomas

[57] ABSTRACT

A projectile firing weapon is disclosed having a simplified construction and a consequent increase in reliability. The trigger and firing mechanism are completely contained within an easily removable and replaceable cassette which may simply be dropped into a cavity in the weapon's stock. The entire barrel assembly may be attached to the stock by a single bolt and a pivoting attachment. The pivoting attachment allows the ready replacement of the barrel assembly or the ready replacement of the firing mechanism actuator cassette should either of them malfunction. The stock and hand grip may be formed of a single piece to further simplify the construction of the weapon.

3 Claims, 28 Drawing Figures

XXIV
XXIII
XXV
18
26
28
20
162
178
178a
174
176
32a
32
80
30
34
35
14
150
36
38
118
42
79
78
156
154
153
152
110
84

PROJECTILE FIRING WEAPON WITH A REPLACEABLE FIRING MECHANISM ACTUATOR CASSETTE

BACKGROUND OF THE INVENTION

1. Field of the Invention

This invention relates to projectile firing weapons, specifically a weapon having a replaceable firing mechanism actuator cassette which contains the trigger and firing mechanism.

2. Brief Description of the Prior Art

Projectile firing weapons such as pistols and rifles have, of course, been known for many years, and have progressed from the basic manually actuated bolt to modern weapons having fully automatic firing capabilities. Some of the modern weapons have the capability of switching from semi-automatic to fully automatic firing and vice versa.

Although the muzzle velocities, accuracy and versatility of the weapons have improved over the years, the basic construction of the weapon has remained rather stagnant. Even the most modern of today's hand carried weapons are relatively heavy and cumbersome, and quickly induce fatigue when carried or manipulated for any length of time by the operator. Today's weapons also utilize a rather complex trigger and firing mechanism, especially those weapons capable of operating in a semi-automatic, a fully automatic, or combination modes. This complexity introduces an inherent unreliability factor in the operation of these weapons, which could prove catastrophic to the user. In addition, such complexity renders the weapons difficult and expensive to manufacture, as well as being extremely difficult, if not impossible, to repair in the field.

SUMMARY OF THE INVENTION

The instant invention obviates the difficulties associated with the prior art weapons by providing a weapon that is lightweight, maneuverable, and one which has increased reliability. The weapon according to the invention has a barrel assembly with a barrel and firing means for the projectile attached to a hand grip or stock. A self-contained firing mechanism actuator cassette is insertable into a cavity defined by the stock such that a sear projecting from the cassette engages and actuates the firing mechanism in the barrel assembly. The cassette is completely self contained and has the trigger, the complete firing mechanism, and the actuating sear mounted within the cassette body. The cassette is also small and lightweight, and several may be easily carried by the weapon user. Should the cassette in the stock suffer any malfunction, it can readily be removed and replaced by a new cassette to keep the weapon in operating order. The firing mechanism actuator cassettes according to this invention may incorporate either a semi-automatic firing mechanism, or a mechanism which is convertible from a semi-automatic mode to a fully automatic mode and vice versa.

In one embodiment of the invention, the barrel assembly is attached to the grip or stock by a pivot device at the rear of the weapon and by a single fastener, such as a screw, toward the forward portion of the weapon. This greatly facilitates the assembly or disassembly of the weapon and enables the user to rapidly change the firing mechanism actuator cassette. This is accomplished merely by removing the single fastener, pivoting the barrel assembly upwardly with respect to the stock, removing the old cassette from the stock, inserting the new cassette and reattaching the barrel assembly to the stock. Alternatively, the barrel assembly may be fastened to the stock by a plurality of fasteners and the pivot mechanism eliminated.

In order to further simplify the construction of the weapon, the stock and the hand grip may be formed from a single piece. The cavity defined by the stock to accommodate the cassette may also have a unique cross-sectional shape which will accommodate only one type of cassette. This can be utilized to positively prevent the weapon from being utilized in a fully automatic mode. In this instance, the unique cross-section would not accommodate the select-fire cassette which is capable of operating in either of the semi-automatic or fully automatic mode.

The firing mechanism contained within the cassette contains the minimum number of parts, which parts may be formed by a simple stamping operation requiring very little, if any, machining. The completed cassette may also be fully encapsulated to prevent contamination from the elements and to prevent any tampering or modification by the user.

Figure 15:
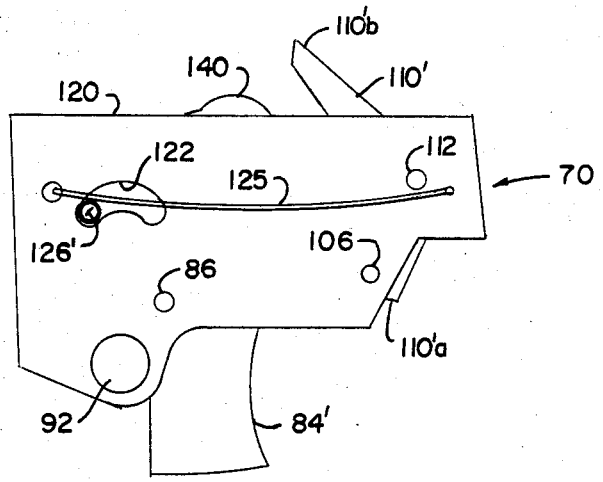
FIG. 15 is a side view of a select-fire firing mechanism actuator cassette according to the invention.
Figure 17:
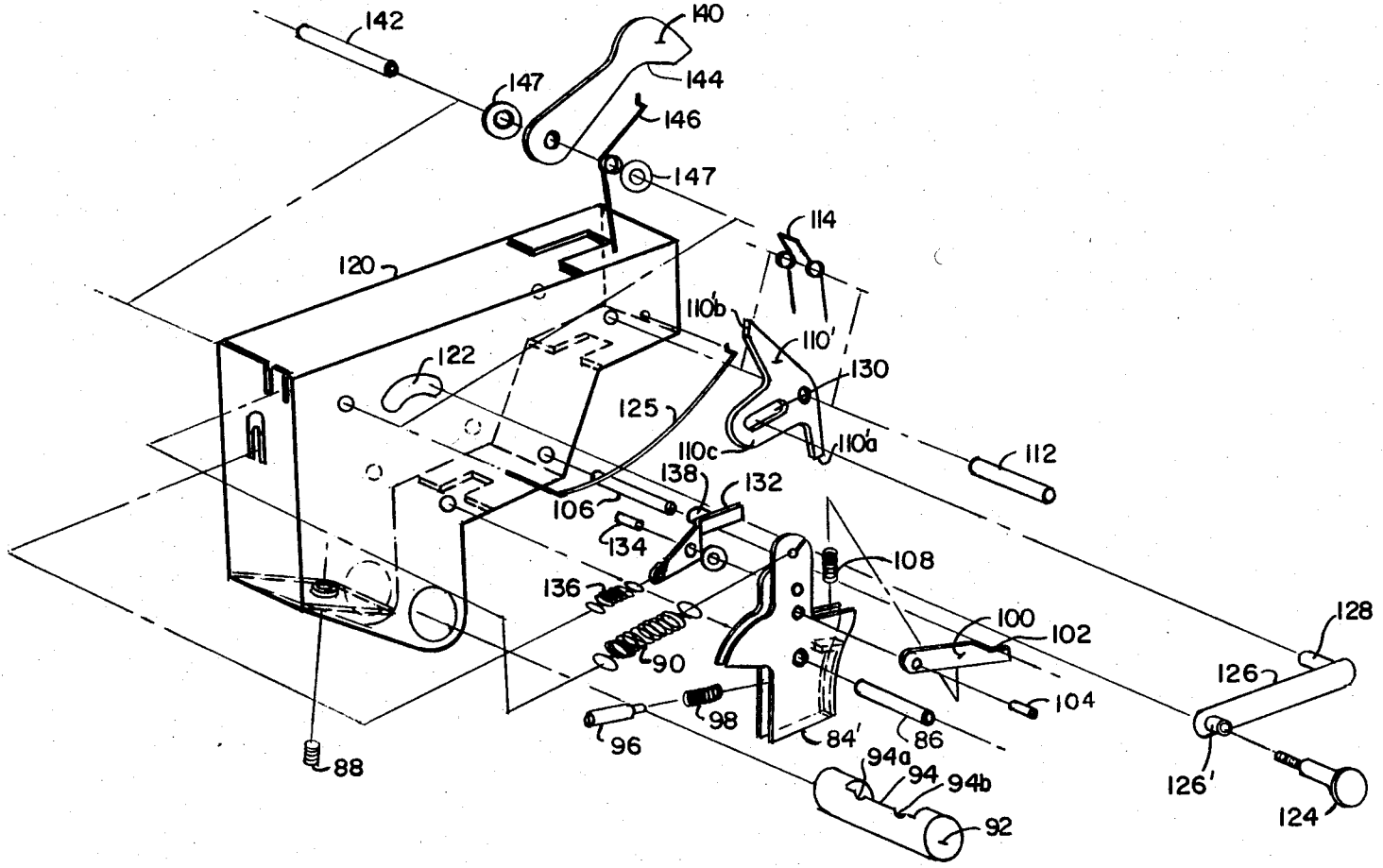
FIG. 17 is an exploded, perspective view of the cassette shown in FIGS. 15 and 16.
Figure 20:
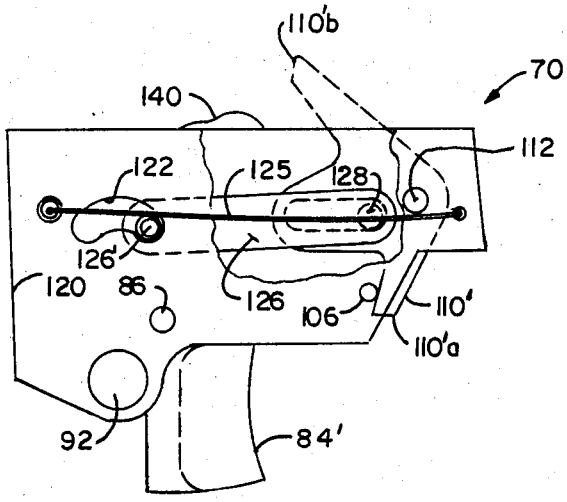

FIG. 20 is a side view, partially broken away, of the cassette of FIG. 15 showing the select-fire mechanism in the semi-automatic position.

Figure 16:
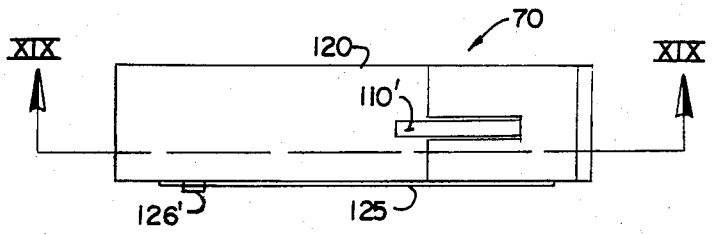
FIG. 16 is a top view of the select-fire cassette shown in FIG. 15.
Figure 21:
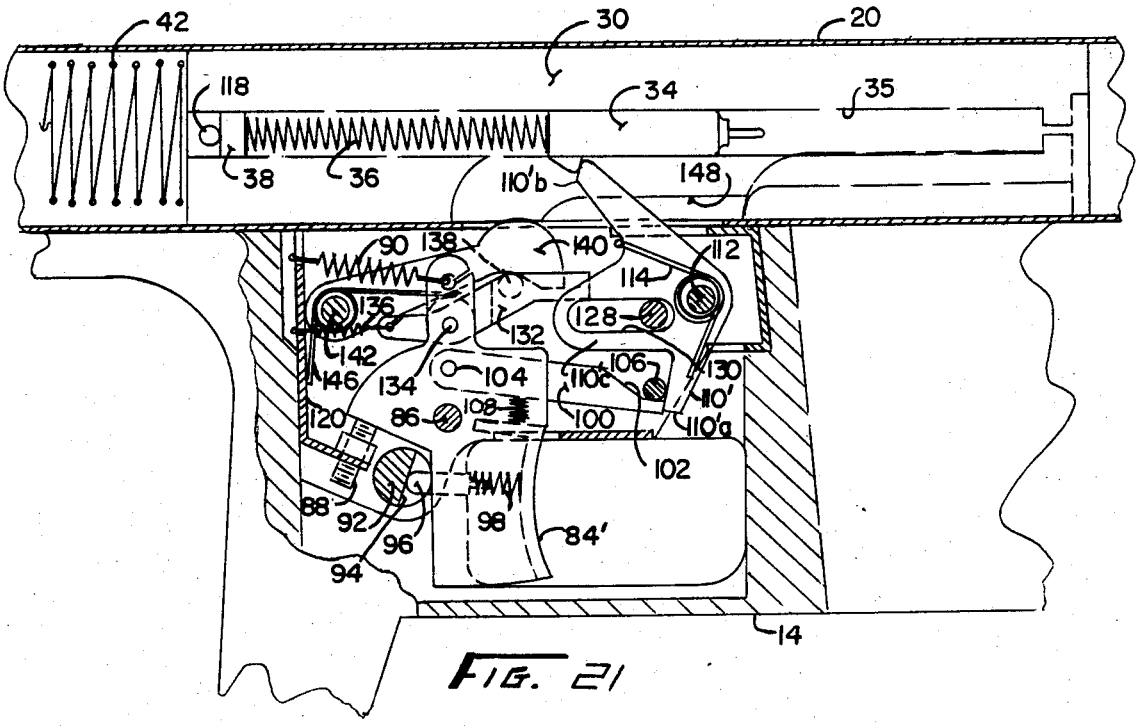

FIG. 21 is a side, sectional view taken along line XIX—XIX in FIG. 16 showing the cassette of FIG. 15 installed in the weapon and the select-fire mechanism in the semi-automatic position.

Figures 22, 23, 24:
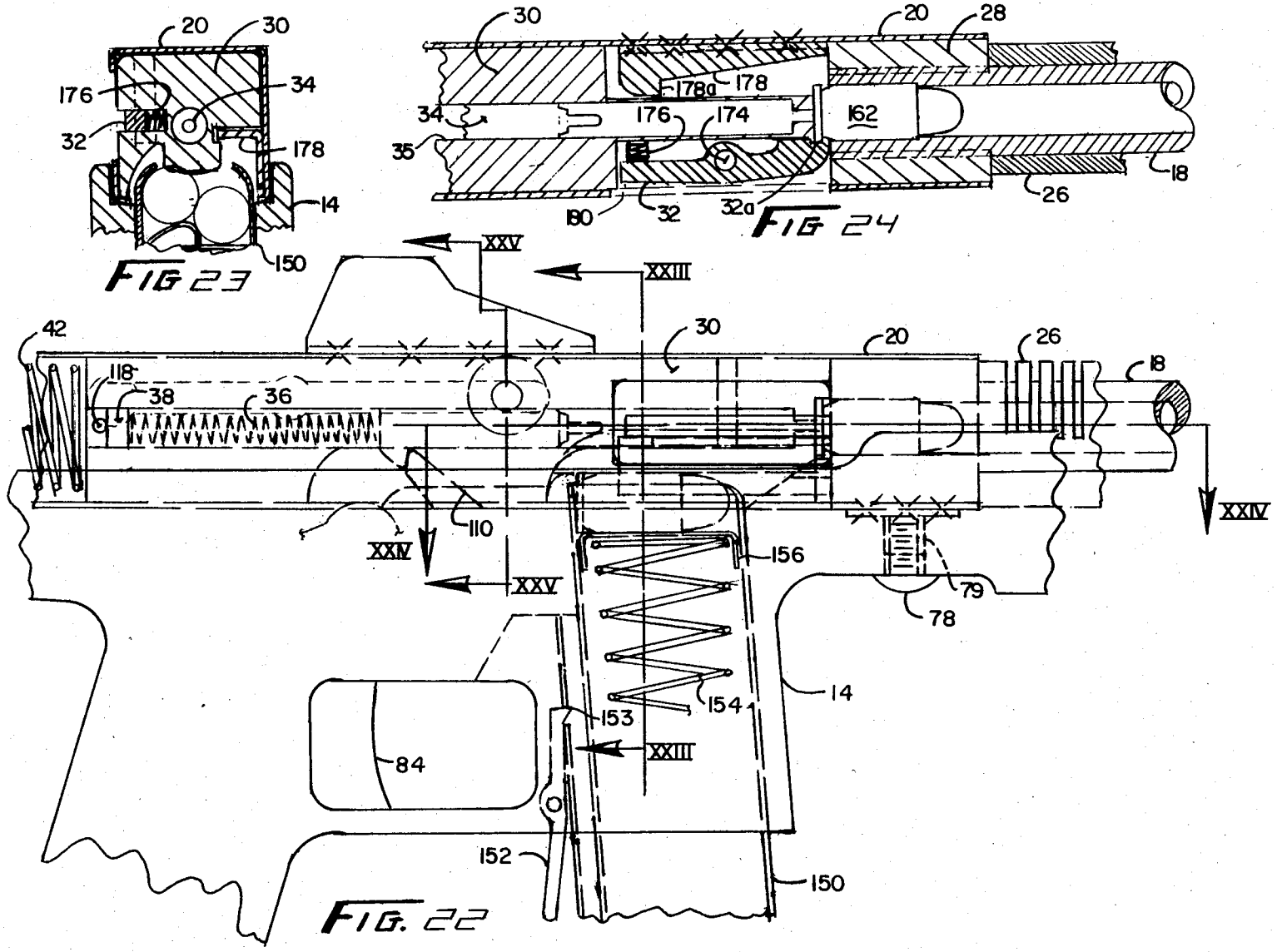

FIG. 22 is a partial side view of the weapon according to the invention showing an installation of a cartridge magazine.

FIG. 23 is a partial, cross-sectional view taken along lines XXIII—XXIII in FIG. 22.

FIG. 24 is a partial, sectional view taken along lines XXIV—XXIV in FIG. 22.

Figure 25:
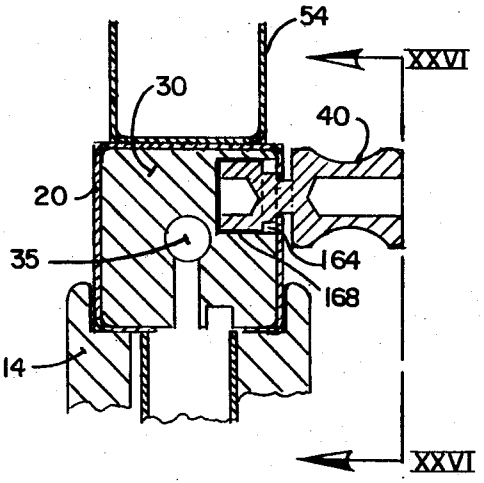

FIG. 25 is a cross-sectional view taken along lines XXV—XXV in FIG. 22.

Figure 26:
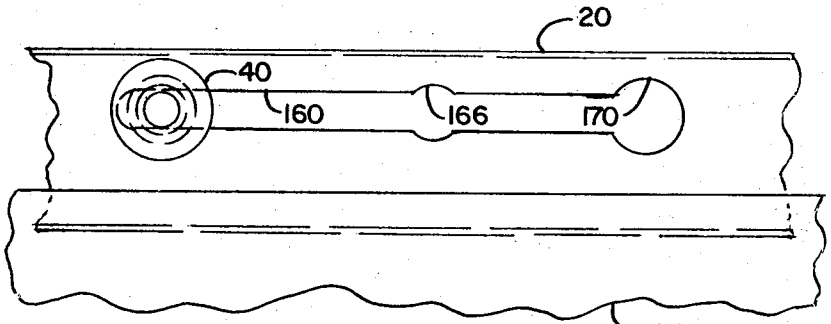

FIG. 26 is a partial side view taken in the direction of lines XXVI—XXVI in FIG. 25.

Figures 1, 2, 3, 4, 5, 6:
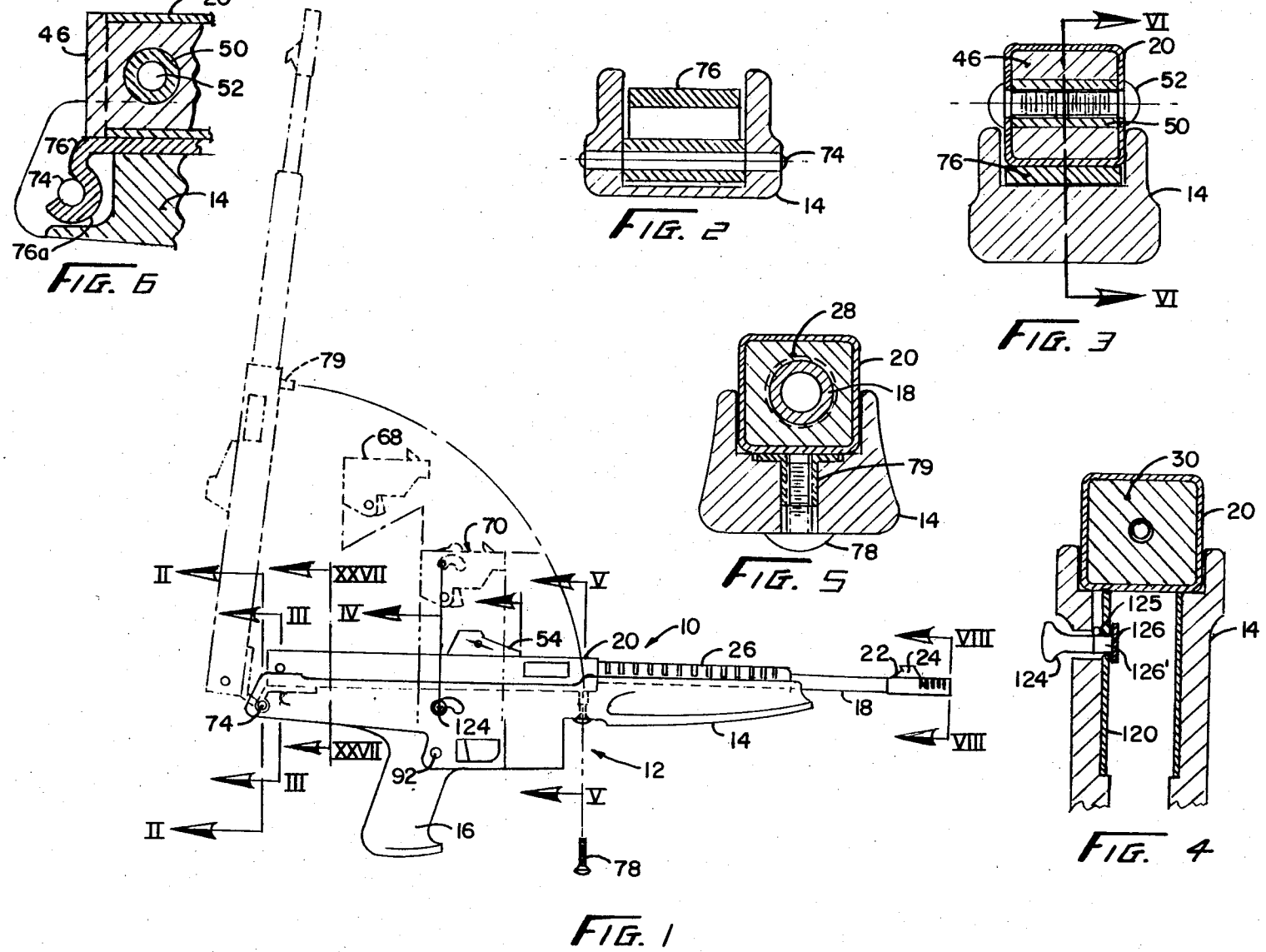
FIG. 1 is a side view of the weapon according to the invention with the barrel assembly pivotally attached to the stock.
FIG. 2 is a cross-sectional view taken along lines II—II in FIG. 1.
FIG. 3 is a cross-sectional view taken along lines III—III in FIG. 1
FIG. 4 is a cross-sectional view taken along lines IV—IV in FIG. 1.
FIG. 5 is a cross-sectional view taken along lines V—V in FIG. 1.
FIG. 6 is a partial sectional view taken along lines VI—VI in FIG. 3.
Figure 27:
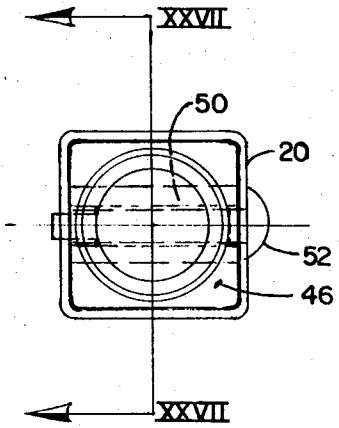

FIG. 27 is a cross-sectional view taken along lines XXVII—XXVII in FIG. 1 showing the recoil damper assembly.

Figure 28:
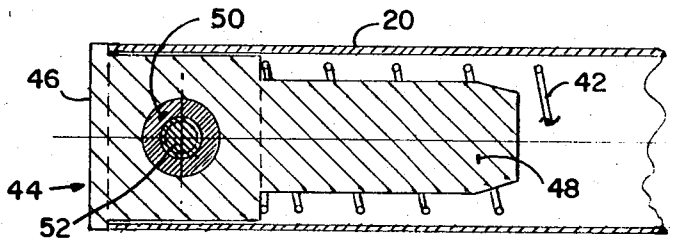

FIG. 28 is a partial, sectional view taken along lines XXVIII—XXVIII in FIG. 27 showing the recoil damper asssembly.

DETAILED DESCRIPTION OF THE PREFERRED EMBODIMENTS

The instant invention relates to a blow-back, operated weapon having the capabilities of operating in fully automatic or a semi-automatic modes. The weapon comprises a barrel assembly, generally indicated at 10, attached to a grip means 12 which may comprise a stock portion 14 and hand grip portion 16. The barrel assembly comprises barrel 18 attached to bolt housing 20 at one end and having muzzle brake 22 attached to its distal end. Muzzle brake 22, to be described in more detail hereinafter, may also contain front gunsight 24 and may be attached to barrel 18 by fastening means 60. Barrel lock and heat sink 26 is attached about the outer periphery of barrel 18 near the bolt housing 20 by fasteners 27 in order to dissipate the heat from the barrel generated during the firing process.

Bolt housing 20 has breach ring 28 mounted therein near the attachment point to the barrel 18. Bolt 30 with extractor 32 and firing pin 34 is slidably retained in bolt housing 20. The firing pin mechanism is slidably retained in bore 35 passing longitudinally through bolt 30, which bore also contains striker spring 36 interposed between the rear portion of firing pin 34 and base plug 38 attached to bolt 30 and retained in position by firing pin retainer 118. Charging arm 40 is attached to bolt 30 and extends exteriorly of bolt housing 20 through slot 160 (see FIG. 26) to facilitate the manual manipulation of the bolt and the initial placement of a cartridge in the firing chamber. Bolt 30 and associated parts mounted thereon may be replaced as a unit under field conditions should malfunction occur.

The rear portion of bolt 30 bears against recoil spring 42 which has its opposite end in contact with recoil damper assembly 44. Recoil damper assembly 44 may be formed of a resiliently deformable plastic material (such as a urethane) having areas of differing durometer. The base portion 46 may be formed from a urethane plastic which is hard, while the buffer portion 48 will be relatively softer to dampen the rearward movement of bolt 30 during the firing process. Recoil damper bushing 50 passes through the damper base 46 and provides a bearing surface for bolt or screw 52 which passes through bushing 50 to attach the recoil damper assembly to the bolt housing. Bolt housing 20 may also have adjustable rear gunsight 54 mounted near the rear on its upper surface.

Figure 8:
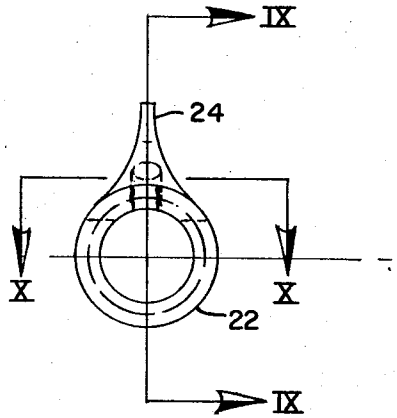
FIG. 8 is a view taken along lines VIII—VIII of FIG. 1 showing the muzzle brake according to the invention.
Figure 9:
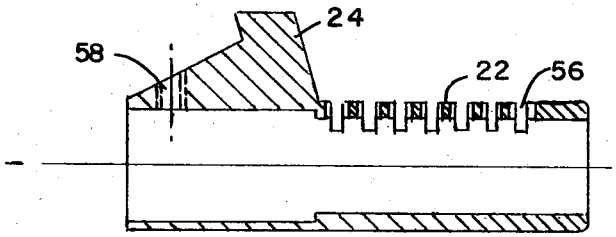
FIG. 9 is a side elevational view of the muzzle braken taken along lines IX—IX of FIG. 8.
Figure 10:
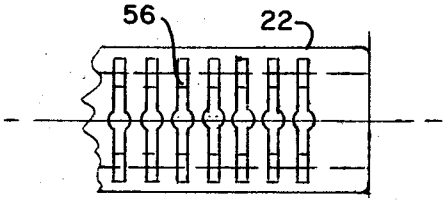
FIG. 10 is a partial, top view of the muzzle brake viewed along lines X—X in FIG. 8.
Figure 12:
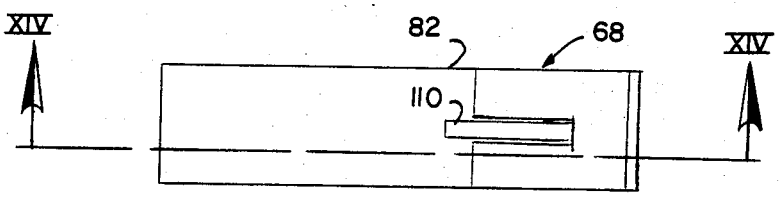
FIG. 12 is a top view of the cassette shown in FIG. 11.
Figure 11:
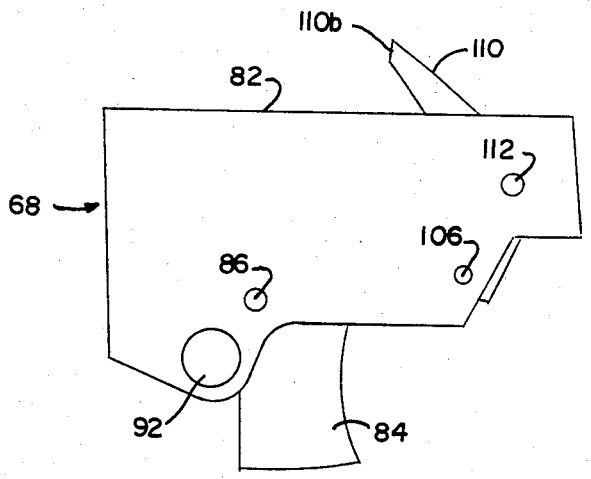
FIG. 11 is a side view of the semi-automatic firing mechanism actuator cassette according to the invention.
Figure 13:
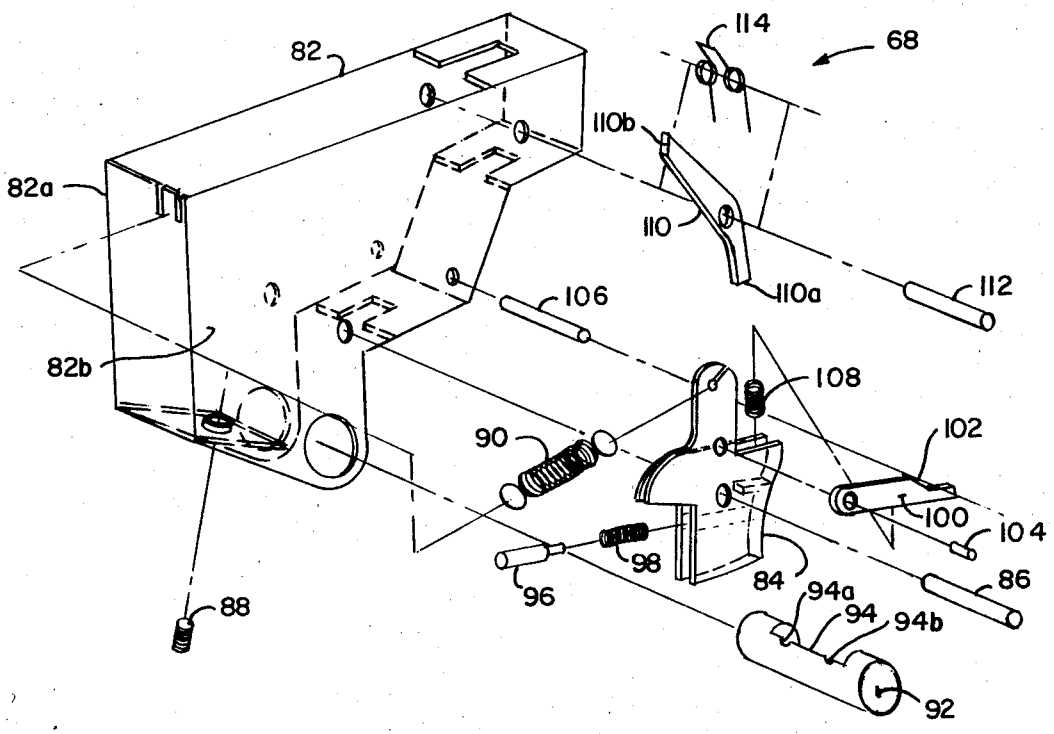
FIG. 13 is an exploded, perspective view of the cassette shown in FIGS. 11 and 12.

As seen in FIGS. 8–10, muzzle brake 22 defines a plurality of upwardly opening slots 56 and threaded opening 58 through which fastening means 60 is inserted to attach it to the barrel end.

Figure 7:
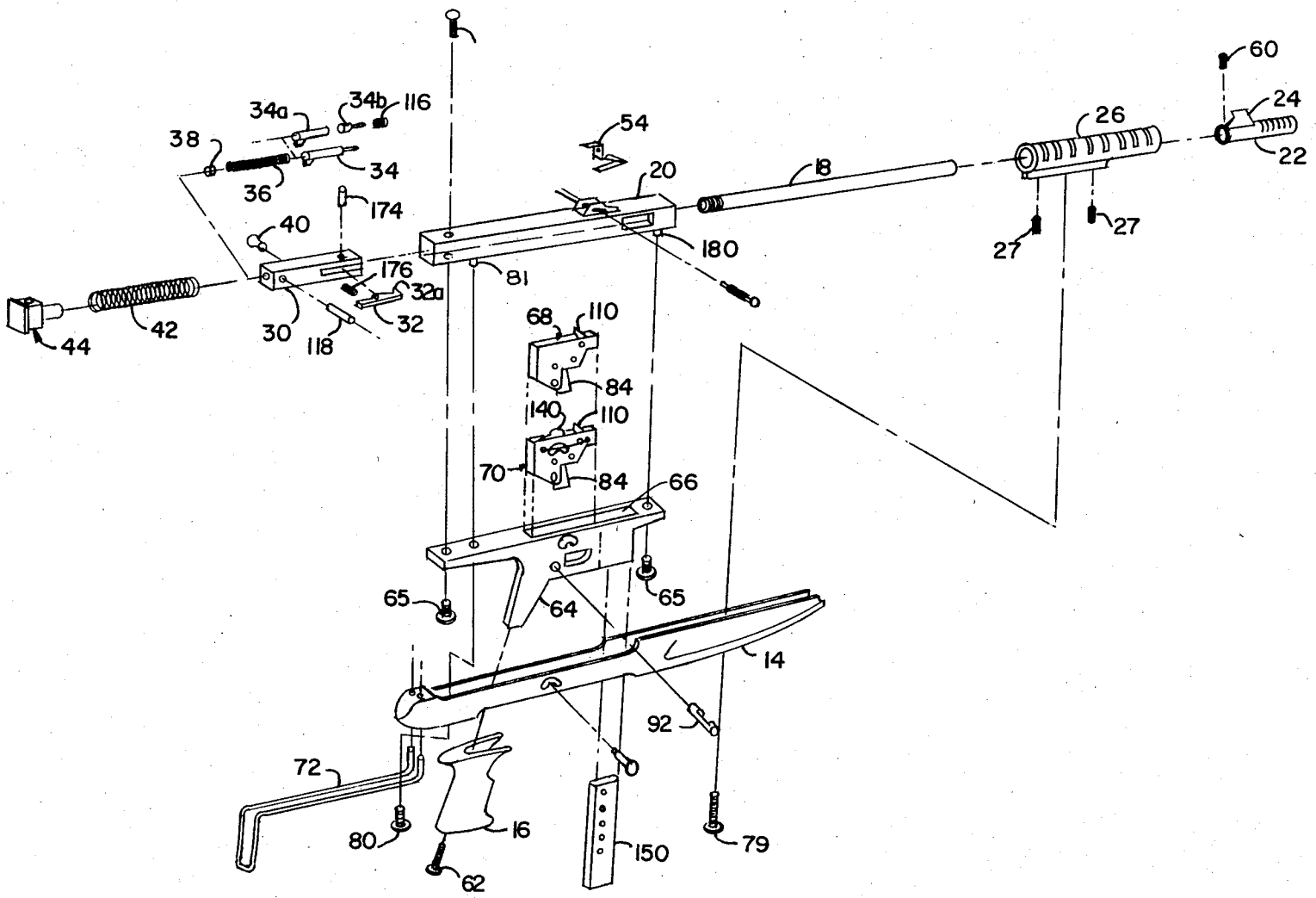
FIG. 7 is an exploded perspective view of an alternative embodiment of the weapon according to the invention.

The grip means 12 may be formed, such as by molding, from a single piece incorporating the stock 14 and the hand grip 16. Alternatively, the stock 14 and the hand grip 16 may be formed separately, as shown in FIG. 7, and retained in assembled relationship via screws or bolts 62. If formed from separate elements, stock 14 will define a cavity to receive cassette retainer 64. Cassette retainer 64, which may be attached to bolt housing 20 by screws 65, defines a cavity 66 to receive and retain either cassette 68, which is designed to fire only in a semi-automatic mode, or select-fire cassette 70 which is capable of firing in a semi-automatic mode or a fully automatic mode. When the stock and hand grip are formed from a single element, stock portion 14 defines a cavity analogous to 66 to receive and retain either one of the cassettes. If it is desired to retrict the ultimate use of the weapon in order to prevent it from operating in the fully automatic mode, cassette retainer 64 or stock 14 may incorporate an inwardly extending ridge or lip which will prevent the insertion of select-fire cassette 70. Semi-automatic firing mechanism actuator cassette 68 will incorporate a corresponding groove to allow its insertion into the weapon, but the absence of such a groove in cassette 70 will prevent its usage. Shoulder brace 72 may be incorporated with either of these embodiments should it be desirable to utilize the weapon as a shoulder weapon. Shoulder brace 72 may, of course, be attached by any known means and may be made to be readily removable to facilitate transportion and storage of the weapon.

The barrel assembly 10 may be pivotally attached to the rear portion of stock 14 as shown in FIGS. 1 and 6. In this embodiment, the rear portion of stock 14 contains transverse pivot pin 74 which is engaged by pivot member 76 attached to the lower rear portion of bolt housing 20. As can be seen, pivot member 76 has a generally "J" shaped depending portion **76*a* which engages pivot pin 74. The front portion of the barrel assembly may be retained against stock 14 via bolt or screw 78 which extends through the stock 14 and engages a correspondingly threaded stud 79 attached to bolt housing 20. In this embodiment, the operator need only remove one screw, screw 78, to allow barrel assembly 10 to pivot about pivot pin 74 in order to replace a firing mechanism actuator cassette. The barrel assembly may also be totally removed from the stock 14 by pivoting it to the position shown in phantom lines in FIG. 1 and lifting upwardly to thereby disengage pivot member 76 from pivot pin 74**. Thus, the entire barrel assembly may be readily replaced by the removal of one screw.

Alternatively, as shown in FIG. 7, attachment between the barrel and the stock may be provided by scew 80 which extends upwardly through the rear portion of stock 14 and engages a correspondingly threaded stud 81 attached to the lower portion of bolt housing 20, as shown in FIG. 7. This eliminates the pivot attachment between the barrel assembly and the stock, while at the same time allows the barrel assembly 10 to be readily removed from stock 14. Bolt or screw 79 may be located in a more forward position than bolt or screw 78 in the previous embodiment to accommodate cassette retainer 64. In this case, it is threaded into barrel lock and heat sink 26.

Semi-automatic firing mechanism cassette 68 is shown in detail in FIGS. 11 through 14 and comprises cassette body 82 which defines an interior space to enclose all of the trigger actuating mechanism. Trigger 84 is pivotally attached to cassette body 82 via trigger pin 86 which extends transversely across the cassette body through aligned openings in the cassette body side walls 82*a* and 82*b*. The rear portion of trigger 84 is biased against trigger stop screw 88 by trigger main spring 90. Trigger main spring 90 has one end attached to an upper extension of trigger 84 while the opposite end is attached to cassette body 82 so as to bias trigger 84 in a counter clockwise direction (as viewed in FIG. 14) about trigger pivot pin 86. Trigger stop screw 88 is threadingly engaged with a portion of cassette body 82 such that the position of its inner end, which bears against the trigger 84, may be readily adjusted. This serves to precisely locate the at rest position of trigger 84.

Figure 14:
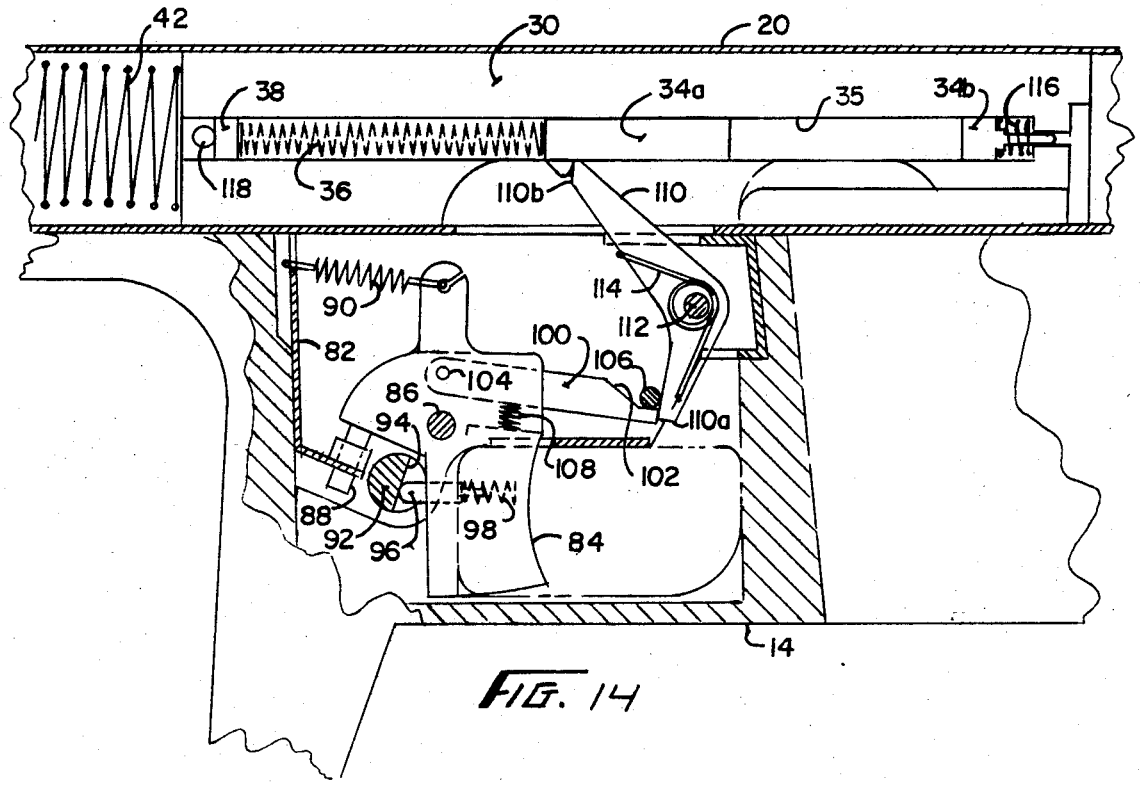
FIG. 14 is a side, sectional view taken along lines XIV—XIV in FIG. 12 showing the cassette of FIG. 11 in the weapon.

Safety 92 also extends transversely between the side walls of cassette body 82 and comprises a generally cylindrical body with a notched central portion 94 with detent notches 94*a* and 94*b*. Safety 92 is mounted within cassette body 82 so as to be rotatable about its longitudinal axis only during installation or removal. Safety dog 96 and safety dog spring 98 are mounted within trigger 84 such that one end of dog 96 bears against the notched cutout surface 94 of safety 92 as shown in FIG. 14. As shown in this Figure, safety 92 is in the released position such that relative movement between trigger 84 and safety dog 96 is permitted by compressing safety dog spring 98. Safety 92 may be traversed along its longitudinal axis to the right such that notched cut out surface 94 is out of alignment with trigger 84. In this orientation, safety dog 96 bears against detent notch 94*a* and holds safety 92 in position. This brings the full diameter of safety 92 into contact with trigger 84 to prevent any clockwise movement about trigger pivot pin 86. Safety dog 96 engages detent notch 94*a* to retain safety 92 in a safe, non-fireable position. Safety 92 is traversed manually to engage trigger 84 for a safe position or fireable position by nature of notch 94 in safety 92. The primary purpose of safety dog 96 is to hold safety 92 in a fire or non-fire position in relation to trigger 84.

Pawl 100 having cam surface 102 is pivotally attached to trigger 84 via pawl pin 104. Cam surface 102 is biased into engagement with pawl actuator pin 106 via pawl spring 108 interposed between pawl 100 and trigger 84. Sear 110 is also pivotally attached to cassette body 82 by sear pin 112 which extends transversely across the cassette body through its sides. Sear actuator spring 114 extends around sear pin 112 and bears against sear 110 to bias the sear in a clockwise direction such that its lower end is biased against pawl actuator pin 106. Lower end 110*a* of sear 110 extends downwardly such that it contacts the end of pawl 100.

End 110*b* of sear 110 extends from the upper portion of cassette body 82 and engages firing pin assembly 34. The firing pin assembly may comprise firing pin striker 34*a* and firing pin 34*b* having firing pin spring 116 interposed between it and the bolt 30. As is well known in the art, firing pin 34*b* has a portion which extends into the firing chamber in order to fire the cartridge in the firing chamber. Firing pin striker 34*a* is biased towards firing pin 34*b* via striker spring 36 interposed between one end of striker 34*a* and base plug 38. Base plug 38 is retained in position in bolt 30 by firing pin retainer 118 which extends transversely across the bore 35 defined by bolt 30.

In order to actuate the firing mechanism from its initial position shown in FIG. 14 the trigger 84 is pivoted in a clockwise direction about trigger pivot pin 86 by a force imparted thereon by the user. This causes pawl 100 to move toward the right thereby rotating sear 110 counterclockwise about sear pin 112 against the bias of sear spring 114. This counterclockwise motion continues until end 110*b* is disengaged from firing pin striker 34*a*. Striker spring 36 causes firing pin striker 34*a* to move rapidly toward the right to contact firing pin 34*b* forcing its end into the firing chamber and firing the cartridge. While this is taking place, continued movement of trigger 84 causes cam surface 102 of pawl 110 to contact pawl actuator pin 106, thereby forcing the end of pawl 100 in a downward direction until pawl 100 disengages itself from the lower end 110*a* of sear 110. Upon disengagement, sear 110 is returned to its initial position due to the biasing force of sear spring 114.

Upon the firing of the shell in the firing chamber, the entire bolt 30 is displaced rearwardly against the bias of recoil spring 42 such that firing pin striker 34*a* is displaced to the left (as seen in FIG. 14) of end 110*b* of sear 110. After bolt 30 has been displaced rearwardly, it is biased in the forward direction by the recoil spring 42 to the position shown in FIG. 14. As bolt 30 moves forwardly to its return position, end 110*b* once again engages firing pin striker 34*a* to restrict its movement as the bolt 30 returns to its original position. This serves to compress firing pin striker spring 36. Upon release of trigger 84, trigger main spring 90 returns it and pawl 100 to their original positions. With this cassette mechanism, the weapon will only fire in the semi-automatic mode. Even if trigger 84 is held in the firing position, pawl 110 will return to its original position shown in FIG. 14 and retain the firing pin striker 34*a* to prevent continued firing.

Select-fire firing mechanism actuator cassette 70, shown in FIGS. 15–21, operates similarly to cassette 68 just described, but has additional capability of operating in a fully automatic mode or a semi-automatic mode. Elements having similar structure and function to those described in relation to the semi-automatic firing mechanism actuator cassette 68 have been assigned the same numbers as those previously described. These elements include trigger pin 86; trigger main spring 90; trigger stop screw 88; safety dog 96; safety dog spring 98; pawl 100; cam surface 102; pawl actuator pin 106; pawl spring 108; pawl pin 104; sear pin 112; and sear spring 114. These elements are all contained within cassette body 120. This cassette body is similar to that previously described, except that one side defines curved opening 122. This opening accommodates selector link extension 126' (see FIG. 17) which extends a short distance from the interior of cassette body 120 and to which is threaded selector knob 124 mounted at the exterior of stock 14, as shown in FIGS. 1 and 4. The exterior end of selector knob 124 is manually manipulable by the operator between the fully automatic position, shown in FIGS. 15 and 18, and a semi-automatic position shown in FIG. 20. Selector assembly spring 125 is attached to the exterior of cassette body 120 such that it bears against an upper portion of selector extension 126' 124 so as to retain the knob 124 in either the fully automatic position or the semi-automatic position.

Figure 18:
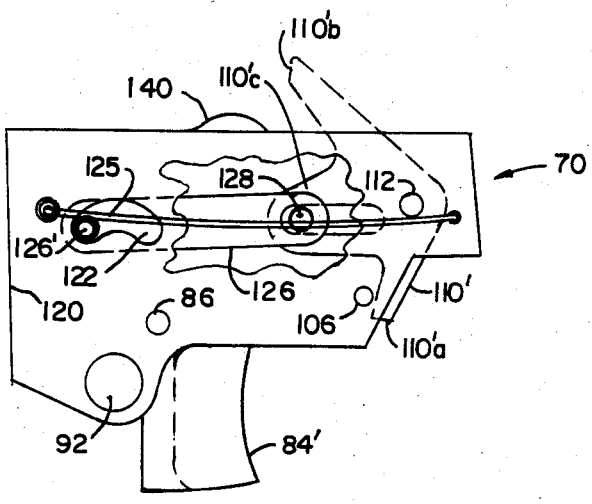
FIG. 18 is a side view, partially broken away, of the cassette shown in FIG. 15 showing the select-fire mechanism in the fully automatic position.

As seen in FIG. 18, selector link 126 extends along the interior of the side wall of cassette body 120 towards sear 110 and has selector pin 128 extending from its opposite end. Selector pin 128 extends in a generally transverse direction and passes through slot 130 formed in rear extension 110'c of sear 110'. The length of selector pin 128 is such that it extends completely through slot 130 and extends a certain distance beyond the opposite side of sear 110' for purposes that will be described hereinafter.

Figure 19:
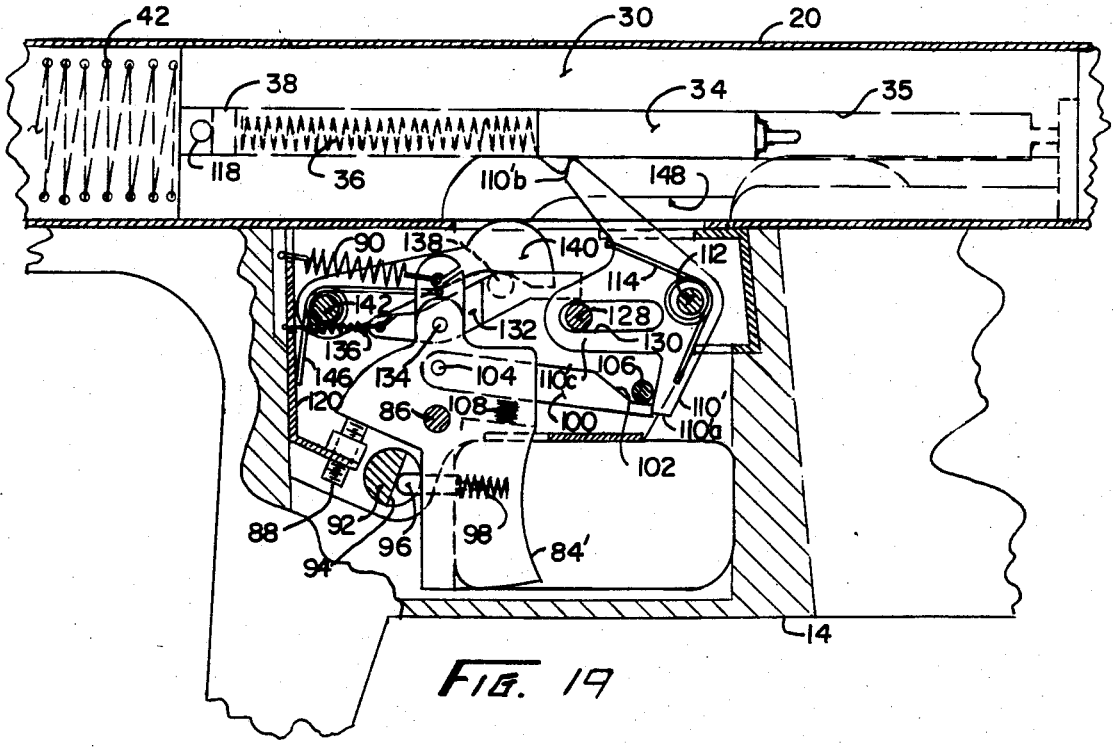
FIG. 19 is a side, sectional view taken along lines XIX—XIX in FIG. 16 showing the cassette of FIG. 15 installed in the weapon with the select-fire mechanism in the fully position.

Sear actuator 132 is pivotally attached to an upper portion of trigger 84' via sear actuator pin 134. A portion of sear actuator 132 extends to the rear of its attachment to the trigger and is connected to housing 120 via sear actuator spring 136. As seen in FIG. 19, sear actuator 132 extends forwardly (to the right as viewed in this Figure) a distance sufficient to engage the upper surface of selector pin 128 when the selector link 126 is in the fully automatic firing position. Intermediate its point of contact with selector pin 128 and its attachment to trigger 84', sear actuator 132 has trip pin 138 extending laterally therefrom.

Trip actuator lever 140 is pivotally attached to cassette body 120 via transversely extending trip actuator piin 142. Trip actuator arm 140 has a lower cam surface 144 which bears against the upper surface of trip pin 138. The upper portion of trip actuator lever 140 extends exteriorly of the cassette body 120, as shown in FIG. 15, and is biased in this position by trip actuator spring 146. Washers 147 may be disposed between the body 120 and the trip actuator assembly to reduce friction during its movement.

The bolt housing 20, bolt 30, and the associated parts of the barrel assembly 10 function the same fashion as in the embodiment previously described. In FIG. 19, firing pin 34 is shown as a single piece assembly rather than a two-piece assembly comprising the firing pin striker 34a and a separate firing pin 34b as shown and described in relation to FIG. 14. It should be understood that either type firing pin may be utilized and the precise structure of the firing pin forms no part of the instant invention.

With the trigger mechanism shown in its normal at rest position in FIG. 19, it can be seen that upper portion 110'b of sear 110' engages the firing pin 34 to prevent its forward movement toward the firing chamber (toward the right as seen in FIG. 19). When the user pulls trigger 84', pawl 100 bears against lower portion 110'a of the sear, thereby pivoting the sear in a counterclockwise direction about sear pin 112. Pawl 100 engages portion 110'a of the sear until the upper portion 110'b has disengaged itself from the firing pin 34, thereby allowing firing pin spring 36 to force the striker 34 toward the right and cause the cartridge in the firing chamber to fire. The explosion of the shell causes the entire bolt assembly 30 to move rearwardly (towards the left as seen in FIG. 19) against the bias of recoil spring 42. This recoil of bolt 30 moves the firing pin to a position to the rear of sear 110'.

As trigger 84' is pulled to move pawl 100 forward against sear 110', sear actuator link 132 is also caused to move forwardly through its connection with the upper portion of trigger 84'. The forwardmost portion of sear actuator link 132 also moves in a downward direction due to the engagement of trip pin 138 with cam surface 144 on trip actuator 140. Thus, as selector pin 128 moves downwardly as a result of the pivoting of sear 110' about sear pin 112, the end of sear actuator link 132 remains in contact with its upper surface. Upon rearward travel of bolt 30, sear actuator lever pivots counterclockwise about its pin 142 into cam slot 148 in bolt 30.

When bolt 30 reaches it rearwardmost position and begins its return due to the action of recoil spring 42, longitudinal cam slot 148 formed in bolt 30 is in contact with the upper portion of trip actuator lever 140. Due to the curved surface of this cam slot, return movement of bolt 30 causes trip actuator lever 140 to move in a clockwise direction about trip actuator pin 142. This imparts downward movement to the end of sear actuator link 132 against trip pin 128 due to the interaction of cam surface 144 and trip pin 138. By this time, pawl 100 has been forced out of engagement with downward end 110'a of sear 110' via the interaction of cam surface 102 with pawl actuator pin 106 as previously described. However, clockwise movement of sear 110' about sear pin 112, which would return the sear to its initial position, is prevented, since selector pin 128 passing through slot 130 is held in position by sear actuator link 132 and trip actuator lever 140. Thus, since the upper end 110'b of sear 110 cannot return to its original position, the bolt 30 and firing pin 34 once again travel to their forwardmost positions to cause the firing of the next cartridge in the firing chamber. The automatic firing continues until the operator releases trigger 84' to thereby allow the parts of the mechanism to assume their initial positions as shown in FIG. 19. Once sear 110' returns to its original position, upper portion 110b engages firing pin 34 to prevent further firing.

In order to enable the weapon to fire in a semi-automatic mode, the selector knob 124 is moved to the other end of slot 122, as shown in FIGS. 20 and 21, thereby causing selector link 126 and selector pin 128 to move forwardly as shown. This forward movement results in selector pin 128 being located toward the forward end of slot 130 in sear 110'. Selector assembly knob 124 is retained in either of the extreme positions in slot 122 via selector assembly spring 125.

The operation of this mode will be described in relation in FIG. 21 wherein the elements are shown in their initial positions. The positions of these parts at rest correspond to the initial positions of the fully automatic mode, as shown in FIG. 19, with the exception of the location of selector pin 128. As trigger 84' is pulled by the user, pawl 100 once again forces sear 110' to pivot in a counterclockwise direction about sear pin 112 due to the engagement of the pawl 100 with the lower end 110'a of the sear. As this engagement continues, the upper portion 110'b is withdrawn from contact with the firing pin 34, thereby allowing it to move forward and discharge the shell in the firing chamber. The recoil of bolt 30 is the same as that previously described in relation to the fully automatic mode.

However, once pawl 100 is disengaged from lower end 110'a, due to the interaction of cam surface 102 with pawl actuator pin 106, sear 110' immediately returns to its original position position due to the biasing force of sear spring 114. The forward location of selector pin 128 prevents any contact between it and sear actuator link 132 as in the fully automatic mode; therefore, the sear 110' is not restricted in its return movement. Return movement of the bolt 30 once again causes longitudinal cam slot 148 to depress trip actuator lever 140 against trip piin 138, thereby moving the end of sear actuator link 132 in a downward direction. Since there is no contact between sear actuator link 132 and selector pin 128, sear 110' is free to return to its original position to engage firing pin 34. This engagement prevents repeated firing of the weapon.

FIGS. 22–26 show the cartridge feeding and extracting mechanism associated with the weapon. The cartridges may be fed from magazine 150 which may be inserted into a cavity defined by stock 14. The magazine is retained in its inserted position by magazine retainer 152 pivotally attached to the stock adjacent the magazine opening. The inner end of magazine retainer 152 has a protrusion 153 which engages a corresponding notch in the magazine. Removal of the magazine may be effected by manually pivoting magazine retainer 152 about its attachment to thereby retract protrusion 153 from the notch. Magazine 150 contains a plurality of cartridges which are spring biased in an upward direction via spring 154 interposed between the lower end of the magazine and cartridge support 156 which is slidably retained within the magazine. The structure of such a magazine is well known in the art and does not form part of this invention.

As shown in FIGS. 25 and 26, charging arm 40 is attached to bolt 30 such that it extends to the exterior of the barrel assembly 10 through slot 160 in bolt housing 20. Charging arm 40 enables the user to manually withdraw bolt 30 from the forwardmost position thereby allowing cartridge 162 to be forced out of the magazine 150. Release of charging arm 40 allows recoil spring 42 to force the bolt forwardly thereby placing cartridge 162 in the firing chamber as shown in FIG. 24. The bolt may be retained in its withdrawn position by laterally displacing charging arm 40 such that enlarged portion 164 engages enlarged opening 166. The charging arm 40 may be completely removed or the bolt retained in its rearwardmost position by interengagement of second enlarged portion 168 with enlarged end 170 of the slot 160.

Once the cartridge 162 has been placed in the firing chamber the weapon may be operated in either mode as previously described. The forward motion of firing pin 34 causes cartridge 162 to discharge thereby forcing the shell of the cartridge and bolt 30 in a rearward direction (towards the left as viewed in FIG. 24). Extractor 32 is pivotally attached to bolt 30 via extractor retainer pin 174. Extractor 32 has a notched end **32*a* which engages the rear of the cartridge shell. End 32*a* is retained in contact with the shell by the biasing force supplied by extractor spring 176** acting on the opposite end.

Ejector 178 is attached to bolt housing 20 as shown. Thus, as bolt 30, along with extractor 32 and the cartridge shell move rearwardly during the recoil action, the end of the cartridge 162 will engage edge **178*a* of the ejector. As the extractor and bolt continue their rearward movement, the cartridge shell is caused to pivot about a vertical axis and be ejected outwardly through opening 180 in bolt housing 20. Before the bolt 30 begins its forward movement, the next cartridge 162** is displaced from the magazine and forced into the firing chamber as the bolt returns to its forward position.

From the foregoing description it is readily seen that the invention provides a reliable and inexpensively manufactured blowback weapon having a pivoting and/or easily removable barrel assembly, and one which is capable of operating in either a semi-automatic or fully automatic mode. This may be accomplished either by movement of a selector or by replacement of a fully contained firing mechanism actuator cassette. The operation of the weapon is such that it always fires from a closed bolt, and its reliability is increased due to the easily replaceable nature of its major components.

The foregoing description is provided for illustrative purposes only and should not be construed as in any way limiting this invention, the scope of which is defined solely by the appended claims.

I claim:

1. A replaceable firing mechanism actuator cassette for a projectile firing weapon having a barrel, grip means and a firing pin comprising:

(a) a cassette body defining an interior space;

(b) a trigger pivotally attached to the cassette body;

(c) a sear pivotally attached to the cassette body, a portion of the sear projecting from the cassette body so as to engage a firing pin of the weapon;

(d) a pawl attached to the trigger and engaging the sear such that, as the trigger is pivoted about its attachment, the pawl causes the sear to pivot about its attachment to thereby disengage it from the firing pin;

(e) first spring means biasing the sear toward a first position in which it engages the firing pin;

(f) a pawl cam surface defined by the pawl;

(g) a pawl actuator pin attached to the cassette body such that it bears against the pawl cam surface, the interengagement of the pin and the pawl cam surface causing the pawl to disengage from the sear after a predetermined amount of travel;

(h) a trip actuator lever pivotally attached to the cassette body and defining a trip lever cam surface;

(i) a sear actuator link pivotally attached to the trigger and bearing against the trip lever cam surface; and, (j) selector means to engage and disengage the sear actuator link and the sear, such that the weapon operates in a fully automatic mode when the sear actuator link and the sear are engaged, and a semi-automatic mode when the sear actuator link and the sear are disengaged.

2. The replaceable firing mechanism actuator cassette of claim 1 wherein the sear defines a slot therethrough and the selector means comprises: (a) a selector knob extending externally of the cassette body and movable between a first position and a second position; (b) second spring means to bias the knob in either its first or second position; (c) a selector link having one end attached to the selector knob and having a second end; and, (d) a selector pin attached to the second end of the selector link and extending through the slot in the sear such that, when the selector knob is in the first position, the selector pin is in a position where it is not contacted by the sear actuator link thereby allowing the sear to return to its first position after being displaced by the pawl so as to operate the weapon in a semi-automatic mode, and, when the selector knob is in its second position the selector pin is contacted by the sear actuator link so as to retain the sear in its second position thereby operating the weapon in a fully automatic firing mode.

3. The replaceable firing mechanism actuator cassette of claim 1 wherein a bolt of the weapon defines a longitudinal cam slot and wherein the actuator trip lever includes a portion extending exteriorly of the cassette into the longitudinal cam slot such that, as the bolt returns to its original position after recoil, the actuator trip lever cam surface is maintained in contact with the sear actuator link.

* * * * *